US008539725B2

(12) United States Patent
Memari et al.

(10) Patent No.: US 8,539,725 B2
(45) Date of Patent: Sep. 24, 2013

(54) EARTHQUAKE DAMAGE RESISTANT GLASS PANEL

(75) Inventors: Ali M. Memari, State College, PA (US); Paul A. Kremer, State College, PA (US); Richard A. Behr, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 1173 days.

(21) Appl. No.: 10/233,670

(22) Filed: Sep. 4, 2002

(65) Prior Publication Data

US 2004/0040232 A1 Mar. 4, 2004

(51) Int. Cl.
*E04B 1/00* (2006.01)

(52) U.S. Cl.
USPC ..... 52/204.5; 52/210

(58) Field of Classification Search
USPC ..... 52/804.5, 235, 162.1, 786, 204.59, 52/204.5, 311.1, 167.1, 167.7–167.9, 204.6, 52/307–308, 200, 203, 204.591, 204.593, 52/204.595, 384, 387, 456, 476, 396.08, 52/396.09, 391.1, 656.5–656.9, 210–213, 52/204.63, 204.58
See application file for complete search history.

(56) References Cited

U.S. PATENT DOCUMENTS

| | | | | | |
|---|---|---|---|---|---|
| 2,205,009 | A | * | 6/1940 | Hamann et al. | 451/226 |
| 2,267,542 | A | * | 12/1941 | Walz | 49/34 |
| 2,805,097 | A | * | 9/1957 | Barber | 52/208 |
| 3,019,135 | A | * | 1/1962 | Orr | 427/110 |
| 3,248,273 | A | * | 4/1966 | Boicey | 428/38 |
| 3,478,478 | A | * | 11/1969 | Luebs | 52/309.1 |
| 3,537,944 | A | * | 11/1970 | Berning et al. | 428/34 |
| 3,727,335 | A | * | 4/1973 | Rochelt | 40/790 |
| 4,427,743 | A | * | 1/1984 | Katsuki et al. | 428/424.6 |
| 4,799,344 | A | * | 1/1989 | Francis | 52/235 |
| 4,994,309 | A | * | 2/1991 | Reichert et al. | 428/34 |
| 5,082,515 | A | * | 1/1992 | Cartier et al. | 156/212 |
| 5,145,744 | A | * | 9/1992 | Cartier et al. | 428/423.7 |
| 5,271,973 | A | * | 12/1993 | Huether | 428/34 |

(Continued)

FOREIGN PATENT DOCUMENTS

| | | | | |
|---|---|---|---|---|
| JP | 07286668 | A | * | 10/1995 |
| JP | 09158619 | A | * | 6/1997 |
| JP | 2001244631 | A | * | 9/2001 |

OTHER PUBLICATIONS

Conference Title: Third International Conference on Earthquake Resistant Engineering Structures, ERES III, E.I. Conference No. 63141, Source: Advances in Earthquake Engineering Earthquake Resistant Engineering Structures III, V 9 2001 Publication Year : 2001.*

(Continued)

*Primary Examiner* — Jeanette E. Chapman
(74) *Attorney, Agent, or Firm* — McDermott Will & Emery LLP

(57) ABSTRACT

Architectural glass panels for use in a wide variety of building wall systems, such as curtain walls and storefronts, which have improved resistance to damage from earthquake and/or other loads that could cause horizontal racking movements of architectural glass panels within their glazing frames are disclosed. Embodiments include various types of architectural glass panels that have material removed at panel corners and are fabricated with smooth edge contours in the corner regions. A preferred embodiment includes various types of architectural glass panels that have rounded corners with or without finished edges.

26 Claims, 12 Drawing Sheets

(56) References Cited

U.S. PATENT DOCUMENTS

| | | | | |
|---|---|---|---|---|
| 5,485,702 | A * | 1/1996 | Sholton | 52/308 |
| 5,834,124 | A * | 11/1998 | Pease et al. | 428/430 |
| 5,904,920 | A * | 5/1999 | Dranoff et al. | 424/93.21 |
| 5,992,111 | A * | 11/1999 | Waterhouse | 52/308 |
| 6,132,882 | A * | 10/2000 | Landin et al. | 428/437 |
| 6,401,428 | B1 * | 6/2002 | Glover et al. | 52/786.13 |
| 6,532,699 | B1 * | 3/2003 | Franklin et al. | 52/29 |
| 6,612,091 | B1 * | 9/2003 | Glover et al. | 52/786.1 |
| 6,787,204 | B2 * | 9/2004 | Chaussade et al. | 428/34 |

OTHER PUBLICATIONS

Memari, A., et al. "Architectural Glass Panels with Rounded Corners to Mitigate Earthquake Damage" Earthquake Spectra, Feb. 2006, vol. 22, No. 1, pp. 129-150.

* cited by examiner a.

b.

EARTHQUAKE DAMAGE RESISTANT GLASS PANEL

The subject matter of this application was made with support of the National Science Foundation under Grant No. 9983896. The Government may have certain rights in the invention.

GOVERNMENT INTEREST

This invention was made with government support under Grant No. 9983896, awarded by the National Science Foundation. The Government has certain rights in the invention.

FIELD OF THE INVENTION

The present invention relates to architectural glass panels suitable for use in a wide variety of architectural glass and building wall system framing combinations. In particular, the present invention relates to architectural glass panels having a modified geometry to improve their resistance to damage during earthquakes and/or other movement of the glass panels within their frames.

BACKGROUND

In light of recent earthquakes in the United States, Japan and elsewhere, considerable attention is now directed toward developing buildings that resist damage during earthquakes. Although the seismic performance of load bearing structures in buildings has improved, "non-structural" or architectural building elements have proved to be vulnerable to earthquake-induced damage. For example, curtain walls (a curtain wall is any exterior building wall comprised of any material, which carries no superimposed vertical loads and is "hung" on the building structural frame) and storefront wall systems have shown the vulnerability of architectural glass and related glazing components to damage during earthquakes. This damage includes serviceability failures (e.g., glazing gasket dislodging, sealant damage, glass edge damage and glass cracking), which require expensive building repairs and could ultimately lead to failures in the form of glass fallout, which present a life safety hazard. Earthquake-induced architectural glass glazing system failures lead to costly repairs and can impose liabilities to building designers, building contractors, building owners and insurers.

In response to concerns about nonstructural damage during earthquakes, recent model building codes, e.g., International Building Code (IBC), 2000 (ICC 2000), now require nonstructural components, such as architectural glass panels, to accommodate the maximum allowed building story drifts. According to IBC 2000, exterior nonstructural wall panels or elements that are attached to or enclose the structure shall be designed to resist the forces prescribed by an equation presented in the model building code and shall accommodate movements of the structure resulting from response to design basis ground motions. In general, seismic codes require wall systems to accommodate drift without much guidance on how to achieve "acceptable" seismic performance for various wall system types. However, as noted by Behr and Wulfert (2001), new seismic design provisions for architectural glass published in the 2000 *NEHRP Provisions* (National Earthquake Hazard Reduction Program 2001) are slated for adoption in the 2003 edition of the IBC. The new NEHRP seismic design provisions for architectural glass are based on a combination of design experience and laboratory test data. Moreover, these provisions now reference AAMA (American Architectural Manufacturers Association) test procedures (AAMA 2001) for determining the serviceability and glass fallout resistance of curtain wall and storefront wall system mock-ups. Although the AAMA standard test procedures do not cover wall system types other than curtain walls and storefronts, these two wall system types are prevalent in modern building practice.

Aside from those glass configurations specifically exempted from mock-up testing in the NEHRP design provisions, selection of appropriate architectural glazing configurations for seismic resistance can be a challenging and iterative process. Fortunately, a series of laboratory studies and some post-earthquake reconnaissance surveys conducted during the last twenty years have generated a significant database on the expected seismic performance of various combinations of architectural glass and wall system framing types (Memari et al. 2002a, EERI 2001, Behr 1998, Behr and Belarbi 1996, Behr et al. 1995a, Behr et al. 1995b, EERI 1995, Pantelides and Behr 1994, Lingnell 1994, Culp and Behr 1993, Wang 1992, King and Thurston 1992, Thurston 1992, Deschenes et al. 1991, Lim and King 1991, EERI 1990, Wright 1989, Evans et al. 1988, Sakamoto et al. 1984, Sakamoto 1978). Additional studies have been directed toward the development of seismic isolation methods for new wall system installations and techniques to predict and mitigate glass damage and glass fallout in existing wall systems (Memari et al. 2002b, Memari and Kremer 2001, Brueggeman et al. 2000, Memari et al. 2000, Zharghamee 1996).

Several methods are available to mitigate architectural glass damage caused by earthquakes, but there is an ongoing need to improve both the glass cracking resistance and the glass fallout resistance in earthquake prone regions and elsewhere.

One method of improving the earthquake resistance of architectural glass is to use laminated glass, which usually consists of two glass plies bonded together with a transparent polymeric interlayer such as polyvinyl butyral (PVB). Specialty laminated glass configurations are also available as glass-plastic laminates and laminates with multiple layers of glass and/or plastic, and all-plastic laminates. Laminated glass, particularly when the glass plies are made of either annealed glass or heat-strengthened glass, is highly resistant to glass fallout because any broken glass fragments remain adhered to the PVB interlayer and resist falling dangerously from the wall system glazed opening. However, individual glass plies in a laminated glass unit are still vulnerable to cracking at drift levels comparable to monolithic glass panels with square-edged corners of the same nominal thickness as the laminated glass unit. Furthermore, a cracked laminated glass unit would still need to be replaced at a significant cost. Hence, the use of laminated glass can improve resistance to glass fallout, but not the resistance to glass cracking.

Another earthquake-resistant glazing method is to apply a polymeric film such as polyethylene terephthalate (PET) over the entire glass surface and to use an appropriate anchoring technique to secure the film edges to the wall system framing. This method, like the use of laminated glass, can resist glass fallout effectively, but does not necessarily resist glass cracking. Although anchored films are used widely to retrofit in-service glass panels, application of anchored films is labor intensive, and often requires a high degree of workmanship in the film application and the film anchorage installation that is a challenge to achieve properly in the field. Unanchored films, sometimes applied as a seismic retrofit measure, are not completely effective in preventing glass fallout due to earthquake-induced building motions (Behr 1998).

For some wall system designs it is possible to use deeper glazing pockets for frame members that hold the glass, thereby providing larger glass-to-frame clearances in an attempt to avoid glass-to-frame contact during racking displacements in an earthquake. This method presumes that the glass panel will have more freedom to translate and rotate within the glazing pocket, thus avoiding early glass failure under racking conditions. This solution, however, is costly in terms of the volume of wall system materials utilized, and is not always preferred architecturally because it requires the use of wide mullions to provide the required glass-to-frame clearances needed to avoid contact. Moreover, if the glass panel is shifted too far laterally in a particular direction due to in-service conditions or faulty installation, the weather seal of the framing system can be compromised and the glass itself could be more vulnerable to cracking under subsequent wall system racking movements.

Finally, seismically isolated wall systems using unitized framing, or the recently developed "Earthquake Isolated Curtain Wall System" (EICWS) are also available. Typically, isolated wall systems are designed to accommodate in-plane racking movements, but the EICWS can accommodate movements in any direction because it permits the multidirectional sliding of the curtain wall in one story relative to adjacent stories. Although the EICWS solution is capable of providing a high level of earthquake resistance to virtually any type of architectural glass and any type of glazing system, the EICWS is designed primarily for new building construction, and, like other seismically isolated wall systems, could impose additional building design and construction costs.

Although methods such as seismically isolated wall systems, glass with anchored safety films, laminated glass, and larger glass-to-frame clearances (i.e., wide mullion designs) can be used to mitigate earthquake-induced building envelope damage, these methods have disadvantages. Specifically, due to cost and complexity, most earthquake-resistant wall systems are tailored primarily for new building construction, not building retrofits; most earthquake-resistant wall systems are significantly more expensive than conventional wall systems not designed specifically for earthquake resistance; most earthquake-resistant wall systems increase glass fallout resistance, but not all of these systems increase the glass cracking resistance; and some earthquake-resistant wall systems limit aesthetic choices in the architectural design of a building's exterior. As a result, there is an ongoing need to improve both the glass cracking resistance and the glass fallout resistance of architectural glass under earthquake loading conditions or conditions that cause such damage.

BRIEF SUMMARY OF THE INVENTION

An advantage of the present invention is that it provides a damage resistant architectural glass panel for buildings.

An advantage of the present invention is that it provides a method of increasing the serviceability (i.e., the glass cracking resistance) of glass panels used in various building wall framing systems.

Additional advantages and other features of the invention will be set forth in part in the description which follows, and in part will become apparent to those having ordinary skill in the art upon examination of the following or may be learned from the practice of the invention. The advantages of the invention may be realized and obtained as particularly presented in the appended claims.

According to the present invention, the foregoing and other advantages are achieved in part by a building comprising at least one rectangular window frame having an architectural glass panel with rounded corners and with or without finished edges properly glazed therein.

Embodiments of the present invention include architectural glass panels that have material removed at panel corners and are fabricated with smooth edge contours in the modified-geometry corner regions. Preferred embodiments of the present invention include glass panels that have their corners rounded, i.e., formed by curving the area where at least two edges or sides of the glass intersect, and/or by finishing their edges. Buildings that employ such modified-geometry glass components within a rectangular frame advantageously resist damage to their glass panels and related damage from broken and falling glass fragments caused by seismic motions. The damage resistant architectural glass panels of the present invention can be employed with various framing materials used in wall system construction, such as glass, stone, aluminum, steel, additional metals or alloys, plastics, rubber, wood, sealants/adhesives and composites of the above.

Another aspect of the present invention is a method of increasing the serviceability of original glass panels in a building. The method comprises replacing or retrofitting the original glass panels in the building with glass panels having rounded corners.

Additional advantages of the present invention will become readily apparent to those having ordinary skill in the art from the following detailed description, wherein the embodiments of the invention are described simply by way of illustrating the best modes contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

The various features and advantages of the present invention will become more apparent and facilitated by reference to the accompanying drawings, submitted for purposes of illustration and not to limit the scope of the invention, where the same numerals represent like structure and wherein:

FIG. 7(*b*) shows a rounded corner glass panel fabricated in accordance with the invention, that includes a shaped edge (e.g., a pencil edge);

FIG. 8(*b*) is an elevation view of one corner of a monolithic glass panel constructed in accordance with the invention by removing material and smoothing the edge surfaces from the corners of the panel.

DESCRIPTION OF THE INVENTION

Figure 1:
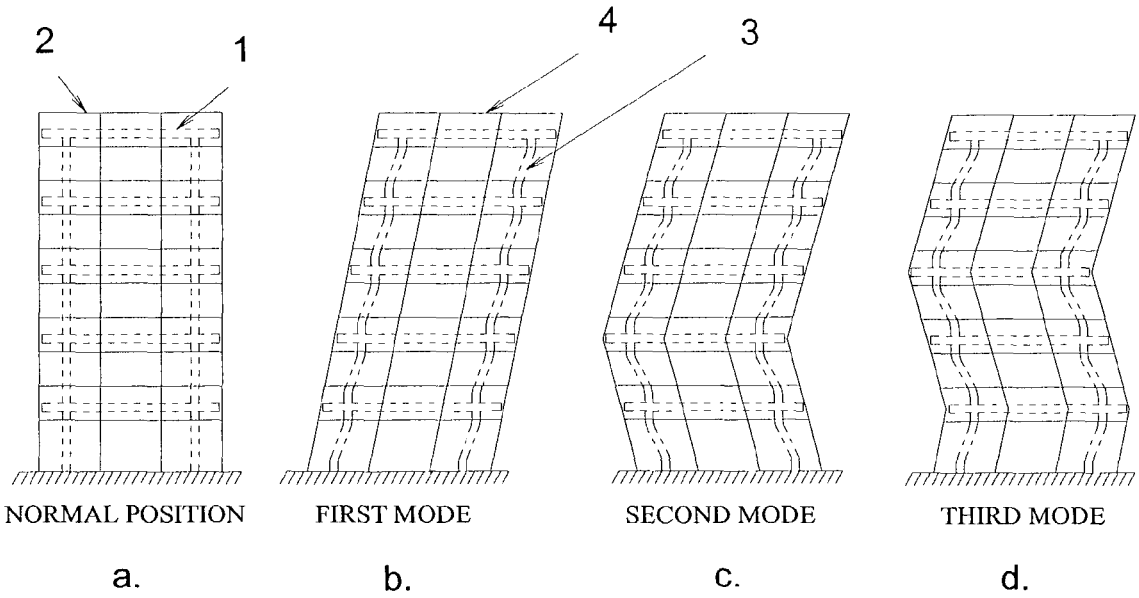
FIGS. 1(*a*), 1(*b*), 1(*c*), and 1(*d*) illustrate schematic representations of the first three natural in-plane vibration modes of a typical building frame clad with a conventional curtain wall system, and their effects on the structural frame and curtain wall of the building.

Laboratory investigations performed by the inventors have revealed that modifying the corner geometry of rectangular glass panels, for example, by rounding the corners of a glass panel and, optionally, by finishing the glass panel edges, economically increases the glass cracking resistance and, to a lesser degree, the glass fallout resistance of virtually any glass component within conventional wall systems. The addition of modified-geometry, or rounded corner glass components within a wall system provides damage resistance in a variety of glass types (e.g., monolithic glass plates, laminated glass units, or insulating glass units) and in a variety of wall system types including curtain walls and storefronts. Research performed by the inventors has also indicated that glass damage under dynamic racking conditions is initiated at the corners of rectangular glass panels. Glass panels having modified corner geometries (e.g., rounded corners) experience reduced contact friction between the glass corners and the glazing pocket, and have slightly reduced glass plate diagonal lengths, which allows them to rotate and translate more freely within the curtain wall frame when the frame is subjected to dynamic, horizontal racking movements as would be expected during an earthquake. The increased mobility of the modified-geometry glass panel within its glazing pocket allows the glass panel to adjust more readily to increased frame deformation and can increase both the serviceability (glass cracking) and ultimate (glass fallout) drift limits of architectural glass panels. [The term "drift limit" is used herein to mean the amount of horizontal racking displacement or drift, that can be tolerated by a given element or component without reaching a defined limit state, such as glass cracking (a serviceability limit state) or glass fallout (an ultimate limit state).] These improvements in glass performance can be attained more economically with modified geometry (e.g., rounded) corner glass panels than with other seismic mitigation methods. The seismic resistance benefit of glass components fabricated with modified corner geometries, with or without finished edges, is provided at only modest cost increments relative to conventional glass components.

The architectural glass panels, made according to the present invention and used in commercial and residential building wall systems, advantageously have an increased ability to accommodate, without glass damage, earthquake-induced building motions as compared to conventional architectural glass panels with rectangular corners.

Glass panels of the present invention can be used as components in simple structural walls or more elaborate wall systems that are designed to provide seismic resistance. Some seismic isolation designs achieve isolation through a special connection of the wall system frame to the building structural frame. It is believed that seismically isolated walls would benefit by using glass panels of the present invention. The glass panels of the present invention may also be used with wide mullions (vertical member in various wall framing systems) with large glass-to-frame clearances (i.e., deep glazing pockets), and to improve incrementally the seismic resistance of architectural glass components installed in a variety of specially constructed wall framing systems designed to accommodate in-plane racking displacements (Zarghamee 1996 and Ting 2001).

Glass panels of the present invention can be used advantageously in both new building construction and building retrofit situations, and within various framing types including, but not limited to, curtain wall and storefront framing with or without seismic isolation connections, and window framing used as infill in exterior building envelope wall systems. When properly fabricated and glazed, glass panels of the present invention can achieve seismic resistance at a lower cost and with less construction complexity than existing seismic isolation methods.

In practicing certain embodiments of the present invention, previously rectangular or other angular (e.g., obtuse or acute angle) glass corners are curved and optionally finished during the fabrication of the glass. It has been discovered that modifying the geometry (e.g., rounding) the corners of a conventional glass panel provides the glass panel with the freedom to reposition itself within the glazing pocket of the conventional wall system frame during earthquake-induced wall frame racking deformations, thereby increasing the in-plane lateral displacement capacity of the wall system as compared to conventional rectangular glass panels with rectangular or otherwise angular corners. As a result, glass panels of the present invention are able to sustain additional inter-story drift before any sign of glass cracking. The term "rounded corner" as used herein includes corners formed by removing glass from the conventional rectangular or angular corner of a glass panel, such as by curving the rectangular or angular corner using a single radius, double or asymmetric radii, or multiple radii. Additionally, the term includes any flat or curved segment formed by the removal of glass from the rectangular or angular corner portion of the conventional glass panel and smoothing the resulting edge surface profile.

It is believed that the mechanics of how this invention improves the performance of architectural glass panels during an earthquake relates to the removal of glass-to-frame contact stress concentration points at the angular corners, which typically occur in conventional, rectangular-cornered glass panels undergoing dynamic racking displacements within a wall system frame.

For example, as depicted schematically in FIGS. 1(*a*) to 1(*d*), under in-plane lateral displacements of buildings during earthquakes, the main structural frame 1 of the building will distort 3. The schematic depictions of the first three natural vibration modes of a typical building frame clad with a conventional curtain wall system 2 shown in FIG. 1 have been limited to in-plane lateral interstory drifts because these are, in general, the most damaging movements to building wall systems. These interstory movements in the building's main structural frame, as shown in FIGS. 1(*b*), 1(*c*), and 1(*d*), typically distort the structural frame 3, causing the normally rectangular curtain wall frame to distort into parallelograms 4, which can lead to subsequent wall system panel (e.g., architectural glass panels, stone and concrete panels, etc.) damage.

Figure 2:
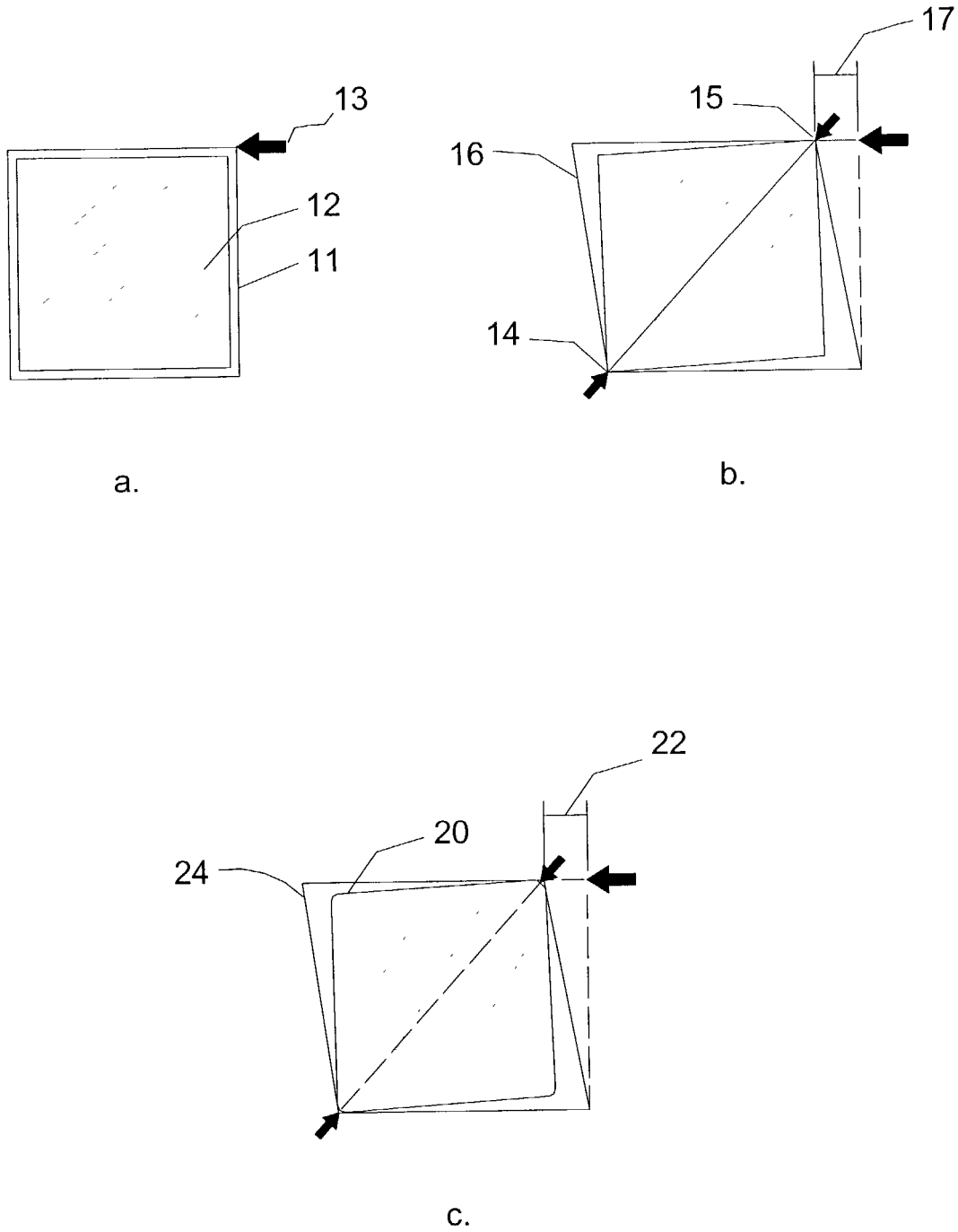
FIGS. 2(*a*), 2(*b*), and 2(*c*) illustrate schematic representations of typical in-plane forces acting on an individual curtain wall element during an earthquake. Glass movements and loads are contrasted for a conventional architectural glass panel with rectangular corners and a rounded corner architectural glass panel.

Most earthquake-induced damage to architectural glass stems from the distortion of the glazing frame that holds the glass component as depicted in FIG. 1 and isolated to an individual frame 11 and glass panel 12 element in the schematic depiction of FIG. 2. As noted by Bouwkamp 1960 and Sucuoğlu and Vallabhan 1997, in-plane deformation of the frame 11 in FIG. 2*a* holding the architectural glass panel under horizontal racking motion (shear force shown) 13 causes the glass panel to translate and rotate within the glazing frame. As shown in FIG. 2*b*, when the corners of one diagonal of the glass plate 14 and 15 make contact with the corners corresponding to the shorter diagonal of the distorted curtain wall frame 16 (in the shape of a parallelogram having inter-story drift 17), additional inter-story drift causes glass to crush and fracture under the in-plane compressive contact forces generated between the glass corners and the corners of the wall system frame. For design purposes, it is preferred that the interaction of brittle glass plates and glazing frame pockets during inter-story drift be accommodated by accepted, verified, seismic design features. The glass panels of the present invention are now one such verified seismic design feature. As shown in FIG. 2*c*, the modified geometry (e.g., rounded corners) shorten the diagonal length of the glass panel 20 and increase the ability of the glass panel of the present invention to accommodate a larger interstory drift 22 of the distorted curtain wall frame 24 before damage due to diagonal compressive forces as compared with the interstory drift 17 of a conventional rectangular-cornered glass panel 12.

In an embodiment of the present invention, rounded-corner glass panels are installed in lieu of rectangular-cornered glass panels in dry-glazed wall system glazing applications employing monolithic, insulating, conventionally laminated, specially laminated (e.g., with advanced interlayers and/or various alternate material layers including polymeric materials such as polycarbonate) or applied film architectural glass panels. It is believed that glass panels of the present invention will find wide application in dry-glazed curtain wall and storefront wall systems. However, a wide variety of wall framing systems may be constructed with glass panels of the present invention to impart increased seismic resistance to the architectural glass panels. Such wall systems use various methods of forming the weather seal (e.g., rubber gaskets, structural sealants or a combination thereof) along the glazed panel perimeter, and in some configurations include provisions for anchoring the glass panel to the framing system. Regardless of the framing system or weather seal materials used, it is preferred that neither the framing nor the weather seal completely impede relative movement of a glass panel of the present invention with respect to its frame. For example, structural sealants are sufficiently flexible to allow movement of the glass panel, but hard glazing components (e.g., dried putty) designed to fix glass within a wall system frame would restrict movement, and wall systems using such glazing components would not fully benefit from glass panels of the present invention. Another feature of the various wall systems employing glass panels of the present invention is that they may employ various methods of attachment of the exterior wall system frame to the underlying main building frame.

Modified-geometry (e.g., rounded) corners may be added to annealed, heat-strengthened, fully tempered or chemically strengthened architectural glass vision or spandrel panels with no change in their method of fabrication, except that the addition of the modified geometry (e.g., rounded) corners should be made at the appropriate stage in their fabrication (e.g., before placement in the heat treatment furnace for heat-strengthened and fully tempered panels, and before the ion-exchange process for chemically strengthened glass panels). The addition of modified geometry (e.g., rounded) corners does not affect the use of solar coatings, thermal coatings, architectural coatings, etc. on glass panels. Glass panels fabricated in accordance with the present invention may be employed as monolithic architectural glass panels or may be used to produce value-added glazing components such as insulating glass units, conventional and specialty laminated glass units including glass-plastic laminates (laminates with multiple layers of glass and/or plastic, and all-plastic laminates), glass-clad-polycarbonate units, and filmed glass units.

Embodiments of the present invention include modified-geometry (e.g., rounded) corner glass panels of any feasible dimension comprising annealed monolithic glass, heat-strengthened monolithic glass, fully tempered monolithic glass, chemically strengthened monolithic glass, etc. Such glass panels may comprise of any number and combination of the above types of glass individually or as glass units, such as insulating glass units, laminated glass units, or as glass composites including, glass-clad-polycarbonate, or glass-plastic laminated panes, and of any feasible dimension and with any appropriate polymeric interlayers/layers and spacer and fill gas.

Figure 3:
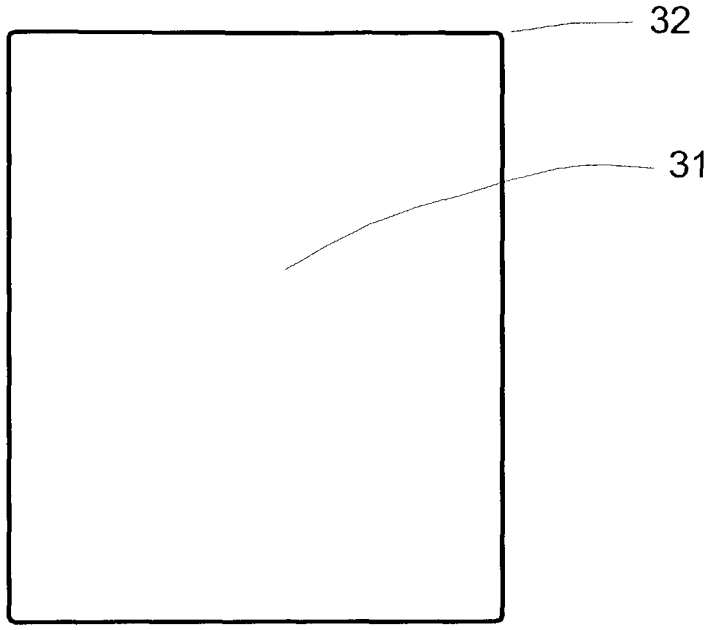
FIG. 3 is a front plan view of a rounded corner monolithic glass panel as fabricated in accordance with an embodiment of the present invention.

The various features and advantages of the present invention will become more apparent and facilitated by the following drawings. In one embodiment, rounded corner monolithic glass panels are used to replace square or rectangular-cornered monolithic glass panels. FIG. 3 is an elevation view of a monolithic glass panel 31 having four rounded corners 32, each of which has a radius of about ¾ in. (about 19 mm). The scaled dimensions of the panel of this embodiment are about 6 ft (about 1.82 m) high by about 5 ft (about 1.52 m) wide, but the panel as drawn is not intended to limit the use of this invention to a particular glass panel aspect ratio or to particular panel dimensions or to a particular panel corner radius, or to a particular panel corner geometry.

Figure 4:
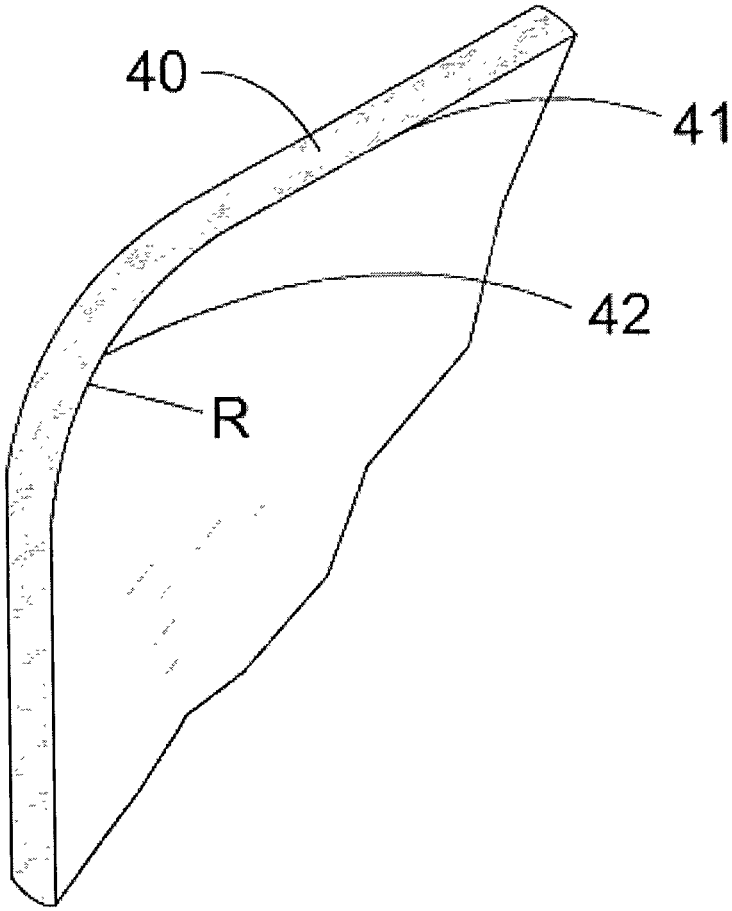
FIG. 4 is an isometric view of a rounded corner monolithic glass panel with about a three quarter inch (about 19 mm) radius of curvature.

An isometric enlarged view of one corner section of the monolithic rounded corner glass panel in accordance with another embodiment of the present invention is depicted in FIG. 4. In this embodiment, the panel has a thickness of about ¼ in. (6 mm). The panel thickness of this embodiment is not meant to restrict monolithic rounded corner glass panels to a particular thickness. However, such panels are typically of thickness normally used in architectural applications (e.g., as specified in ASTM C1036). The glass panel is drawn with a cut edge 41 as is typically employed for annealed glass panels. In general, modified geometry (e.g., rounded) glass corners may be used in conjunction with the standard edge finish applied to panels of a given glass type (e.g., cut or scored edges in annealed glass; belt seamed edges for heat-strengthened and fully tempered glass; etc.). However, in a preferred embodiment of the invention, refined edge finishes may be used as subsequently described. The glass panel corner 42 in FIG. 4 is also drawn with a corner radius of about ¾ in. (about 19 mm), which is not meant to limit application to this embodied corner radius. Corner radii within the preferred range of about ½ in. (about 13 mm) to about 2 in. (about 51 mm) provide glass cracking resistance, and, for most radii, glass fallout resistance superior to that of a comparable rectangular-cornered glass panel. Evidence of this is found in FIG. 5, which is a presentation of the drift limit states observed for various monolithic glass panels dry-glazed with rubber gaskets, rubber side spacers and rubber setting blocks in a conventional extruded aluminum curtain wall frame and tested in accordance with the AAMA 501.6 recommended dynamic test method for determining the seismic drift causing glass fallout from a wall system. Thus, the choice of corner radii for monolithic glass panels of any glass type is based primarily on the requirement that no modifications to the glazing components for a particular wall system be required. For example monolithic glass panels with corners rounded within the range of radii from about 12 in. (about 13 mm) to about 2 in. (about 51 mm) may be used with conventional framing systems.

Figure 5:
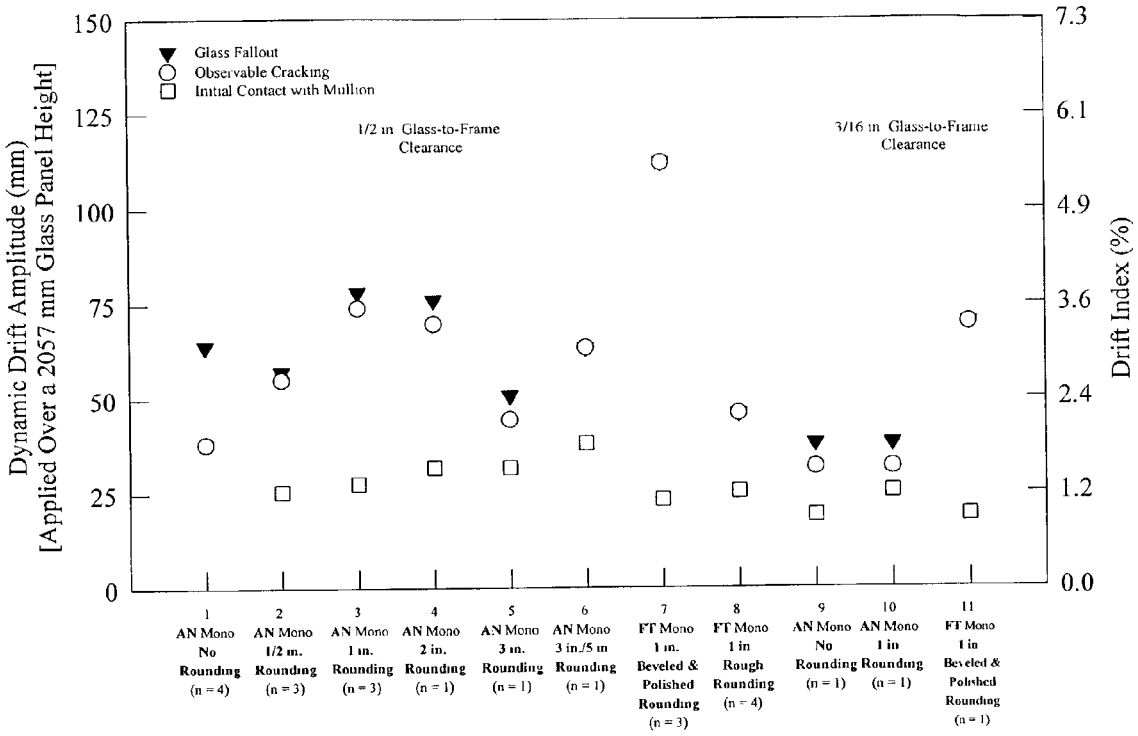
FIG. 5 is a graph comparing the dynamic racking performance (tested in accordance with AAMA 501.6) of monolithic rounded corner glass panels to the performance of identically constructed glass panels with rectangular corners.

In the case of the framing system used for the concept verification tests whose results are presented in FIG. 5, based on the test results for corner radii of ½ in. (13 mm) and 1 in. (25 mm) shown in FIG. 5, it is concluded that a corner radius of about ¾ in. (about 19 mm) is preferred, because it would provide the highest glass cracking and glass fallout resistance, while still maintaining the weather seal (i.e., air and moisture cannot pass through) in the corner regions of the glazed frame if the glass panel were shifted entirely to one side or the other of the glazing frame. FIG. 5 also shows the comparative test results of annealed and fully tempered monolithic glass panels glazed in a conventional curtain wall frame with about a ½ in. (13 mm) and about a 3/16 in. (5 mm) nominal glass-to-frame clearances.

Standard or conventional cutting tolerances for fabricating the modified geometry (e.g., rounded) corners may be used. However, as indicated by the test results presented in FIG. 5, results are enhanced by improving the quality of the edge finish. During the tests underlying the data presented in FIG. 5, it was observed that glass panels fabricated with protrusions along the rounded corners did not perform as well under dynamic racking motions as similarly fabricated rounded corners with no protrusions. AAMA 501.6 testing on glass panels manufactured with visible protrusions and other edge defects (such as chips and spalls) along their perimeter edges have also been observed to exhibit lower drift limits than their counterparts with no visible edge defects. Hence, in a preferred embodiment of the invention, it is preferred that the edges of rounded corner glass panels have smooth surfaces to avoid the possible detrimental effects of edge surface defects.

Figure 6:
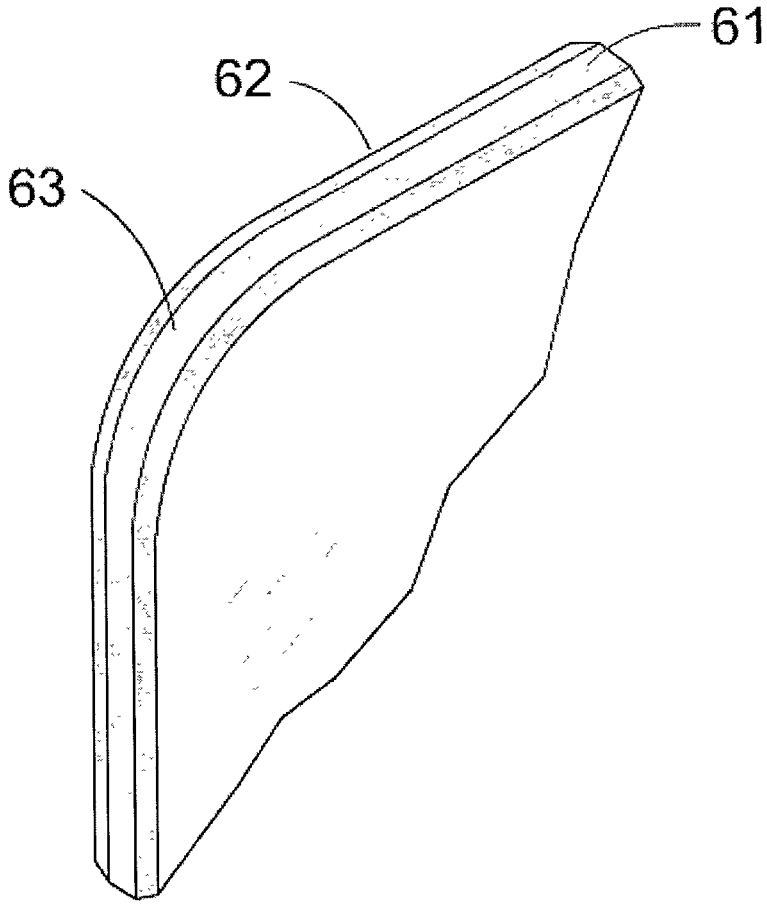
FIG. 6 is an isometric view of a rounded corner monolithic glass panel with about a three quarter inch (about 19 mm) radius of curvature and including beveled and polished edges.
Figure 7:
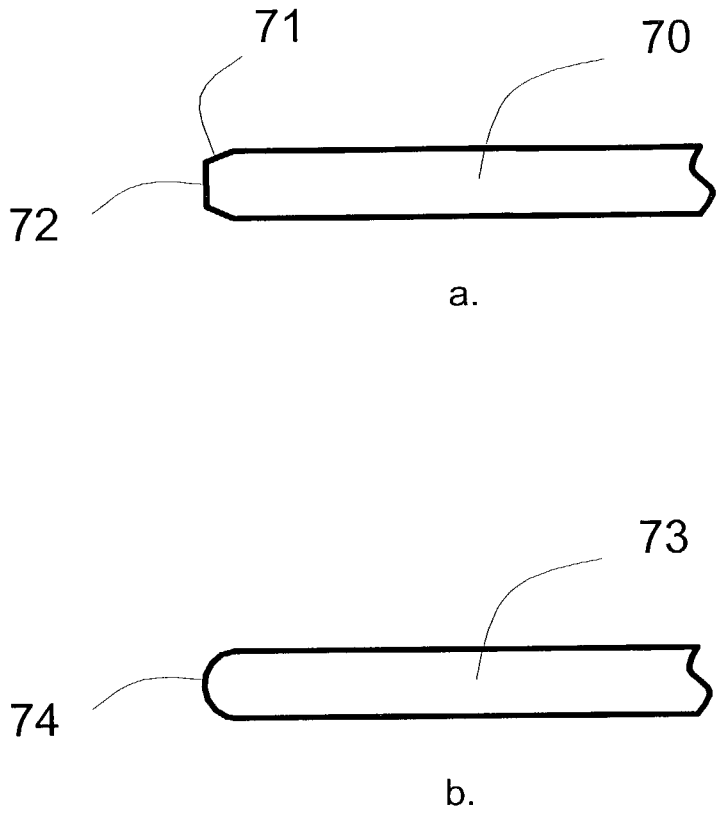
FIG. 7(*a*) is a cross-sectional side view of the edges of a rounded corner glass panel fabricated in accordance with an embodiment of the present invention, including a ground or polished edge.

FIG. 6 illustrates another embodiment of a rounded corned glass panel. This figure shows an isometric view of one corner section of a ¼ in. (6 mm) thick monolithic rounded corner glass panel with a ¾ in. (19 mm) corner radius 63. This embodiment is an example of a rounded corner glass panel having a ground or polished edge 61. As previously noted, these thickness and corner radii dimensions are not meant to limit the construction of a beveled and polished rounded corner glass panel to these dimensions. FIG. 7*a* shows a cross sectional view of a portion of an edge of a rounded corner glass panel 70 having a ground or polished edge 71-72. Grinding and polishing operations may be achieved by conventional additional fabricating steps as known to those skilled in the art of glass fabrication. The additional steps of grinding and polishing the edges of modified geometry (e.g., rounded) corner glass panels may be practiced on practically any panel constructed of any glass type, and, in addition to corner rounding, represents another embodiment of the invention whose improved level of glass edge surface refinement provides a more consistent (if not higher) level of seismic resistance to a given glass panel. FIG. 7(*b*) shows a rounded corner glass panel 73 fabricated in accordance with the invention, that includes a shaped edge 74 (e.g., a pencil edge), which may be ground or polished.

Figure 8:
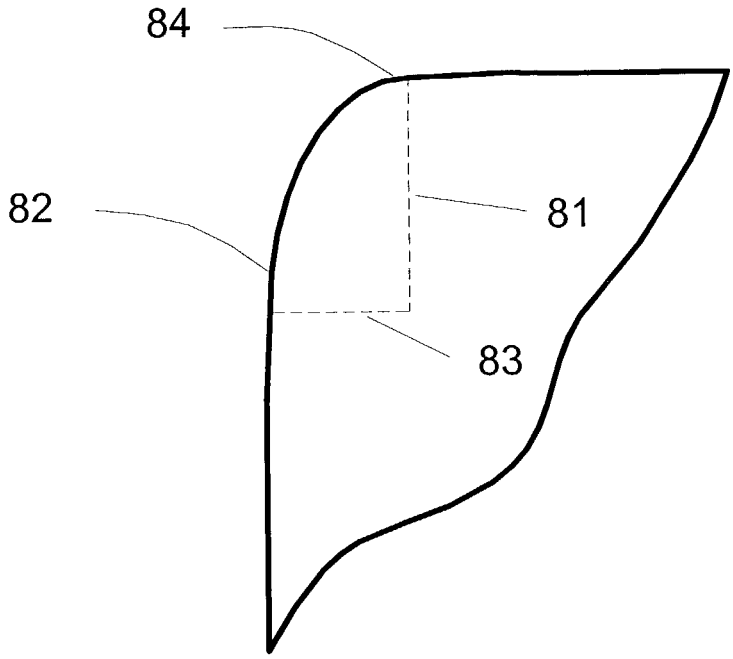
FIG. 8(*a*) is an elevation view of one corner of a monolithic glass panel constructed with asymmetrically rounded corners.
Figure 8:
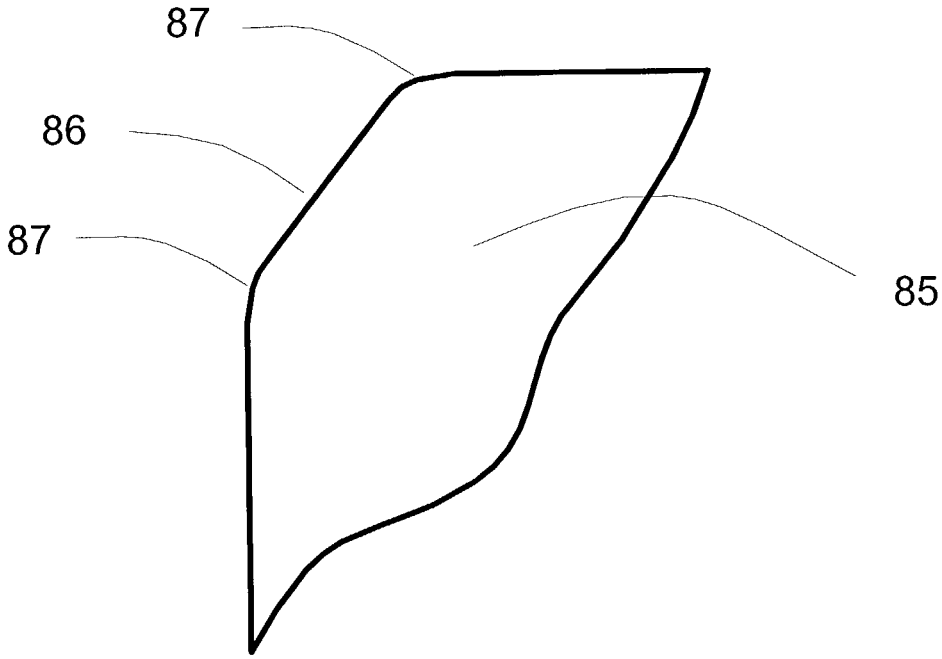

Another embodiment of the present invention applicable to architectural glass panels of any glass type is depicted in FIG. 8(*a*). In this schematic elevation view of one corner of a monolithic rounded corner glass panel, asymmetric rounding has been employed to provide one radius 81 along the vertical rounded corner edge 82 and another radius 83 along the horizontal rounded corner edge 84. Asymmetric rounding can be used to provide additional drift capacity of a rounded corner glass panel used in framing systems with small glass-to-frame clearances.

Another embodiment of a damage resistant glass panel of the present invention, which is illustrated by the exemplary glass panel 85 shown in FIG. 8(*b*), is obtained by fabricating the glass panel by removing material from the corners of the panel and providing a smooth contour along the edges of its corners 86-87. Glass panels fabricated in this manner may have corners with a modified geometry that deviates from the well formed standard and asymmetric radii previously discussed, yet still provide superior glass cracking and glass fallout resistance to comparable rectangular cornered glass panels during earthquake racking motions. Moreover, these panels can be used in lieu of the rounded corner glass panels formed with standard and asymmetric radii in the glass unit constructions set forth in the embodiments below.

Figure 9:
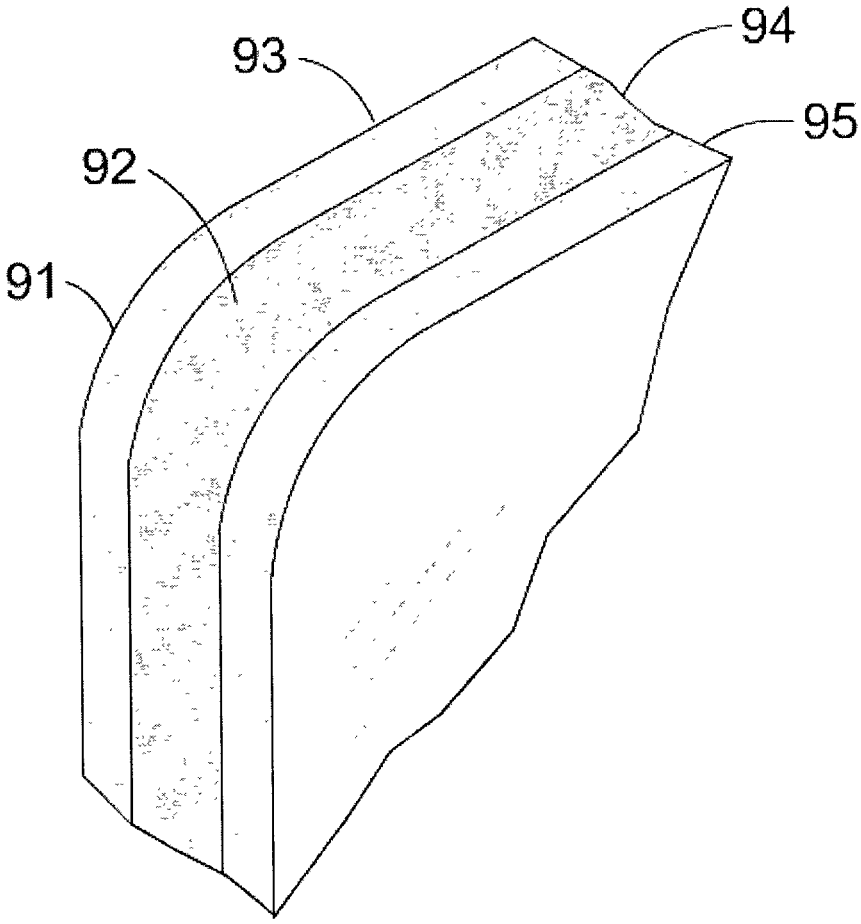
FIG. 9 is an isometric view of one corner of an insulating glass unit comprised of glass panes with rounded corners.

FIG. 9 depicts another embodiment of the present invention, wherein an isometric view of one corner of an insulating glass unit (IGU) is shown. The IGU is constructed with two rounded-corner radius 91 monolithic glass panes 93 and 95. The panes in this embodiment are nominally ¼ in. (6 mm) thick and each pane corner has a nominally ¾ in. (19 mm) rounded-corner radius 91. A perimeter spacer 94 separates the two panes of glass. This spacer in this embodiment is about ½ in. (13 mm) thick and the interior may be filled with air or an inert gas (e.g., argon) and the exterior may be sealed with a perimeter structural sealant 92 IGUs constructed with any number and combination of monolithic, laminated or filmed glass panes can be formed from modified-geometry (e.g., rounded) corner glass panes with the same dimensions or with any other dimensions suitable for constructing IGUs. Some considerations in the fabrication of insulating glass units constructed with modified-geometry (e.g., rounded) corner glass panes include glass pane alignment (minimal in-plane alignment offset of one pane with respect to the other), spacer design and the specific corner geometry and edge surface conditions of the individual panes. IGUs constructed with aligned glass panes offer maximum in-plane racking resistance. A variety of spacer technologies are available for IGUs, all of which may be used in IGUs constructed with modified-geometry (e.g., rounded) glass corners, but could require some adjustment to accommodate the IGU corner geometry selected for a particular application. For most currently used IGU spacer systems, about a ½ in. (13 mm) corner radius on the glass panes may be employed without requiring the use of anything but a conventional IGU spacer. Generally, details regarding corner geometry and glass edge surface finishes specified above for monolithic glass panels are applicable to the individual glass panes used in a given IGU construction. Moreover, glass beveling and polishing operations, and asymmetric rounding are also applicable to the individual panes of IGUs of the present invention.

Figure 10:
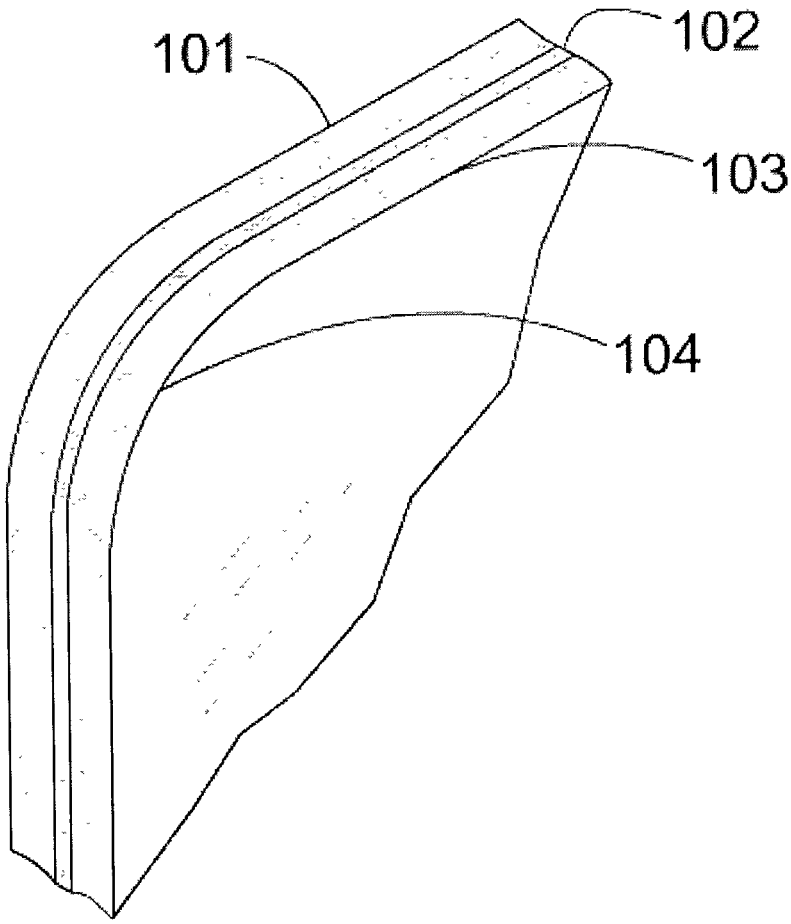
FIG. 10 is an isometric view of one corner of a laminated glass unit comprised of glass plies with rounded corners.
Figure 11:
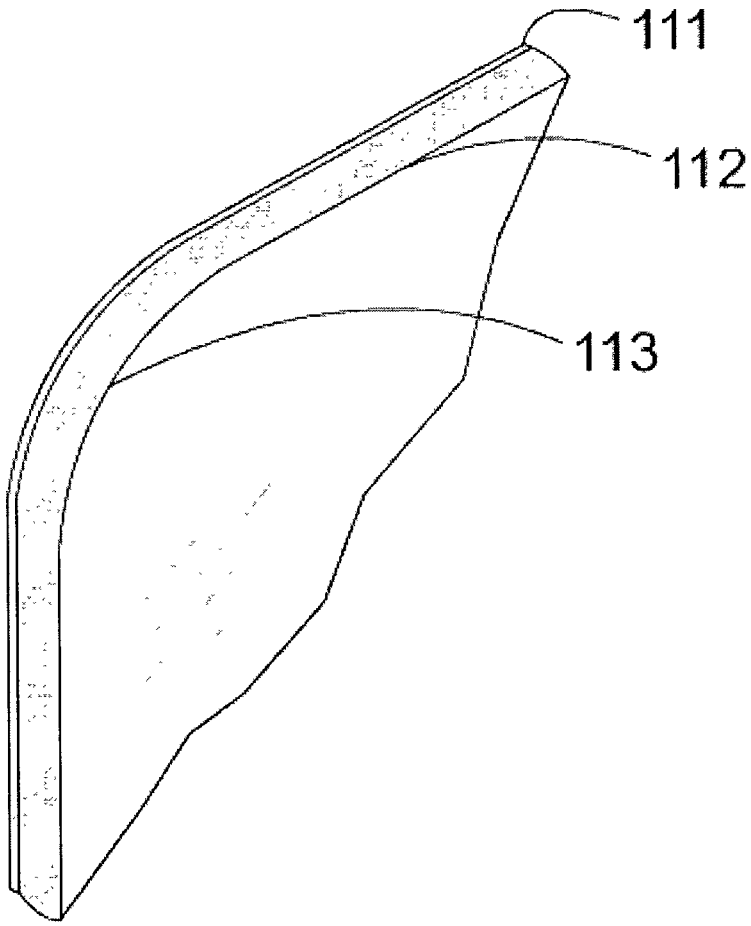
FIG. 11 is an isometric view of one corner of a filmed glass panel employing rounded corners.

FIG. 10 is yet another embodiment of the present invention illustrating the invention. Therein, a laminated glass unit is illustrated by an isometric view of one corner of a fabricated and glazed laminated glass unit. The laminated glass unit is constructed with two, 3/16 in. (5 mm) thick, ¾ in. (19 mm) rounded-corner radius 104 monolithic glass panes 101 and 103 adhered to each other with a polymeric interlayer 102 having a thickness of about 0.060 in. (1.52 mm). The present invention contemplates the use of a variety of laminated glass units. These laminated glass units may be constructed with any number or combination of monolithic glass (of any glass type) and/or polymeric layers (e.g., plastic panes) and can be formed from glass panels of any type and dimensions with modified geometry (e.g., rounded) corners. As with insulating glass units, alignment of glass plies is a consideration in the manufacture of laminated glass units employing the present invention. Selection of an appropriate corner geometry can be made in the same manner as that described for monolithic glass panels. Although polyvinyl butyral (PVB) is typically used as the interlayer material to bond glass plies in conventional two glass ply laminated glass unit construction, other interlayer/layer materials may also be used in laminated glass units constructed with modified-geometry (e.g., rounded) corner glass panels with no modifications required in their fabrication. It is preferred that the polymeric interlayer(s)/layer(s) material(s) be trimmed to the profile of the glass at the modified-geometry corner regions. Such laminated panels would include specialty laminated panels comprised of a glass ply and single or multiple polymeric layers adhered to the glass and/or each other for the purposes of imparting impact and abrasion resistance to the panel, among other desirable performance attributes. Generally, details regarding corner geometry modifications and glass edge surface finishes specified above for monolithic glass panels are applicable to the individual glass plies in a given laminated glass unit configuration. Moreover, glass beveling and polishing operations and asymmetric rounding are also applicable to the individual plies of laminated glass units of the present invention.

Monolithic glass panels having a polymeric film thereon can also be used in accordance with the present invention. An embodiment of which is shown in FIG. 1, which shows an isometric view of one corner of a fabricated ¼ in. (6 mm) thick, ¾ in. (19 mm) rounded corner radius 113 monolithic glass panel 112 with a 0.007 in. (0.178 mm) applied polymeric film 111. Any glass type with dimensions and modified geometry (e.g., rounded) corners and glass panel edges fabricated as described previously, or architectural applied film type, may be used without modification, although it is preferred that the polymeric film be trimmed to the profile of the glass at the modified-geometry corner regions. Selection of an appropriate corner geometry may be made in the same manner as that described for monolithic glass panels. Generally, details regarding corner geometry modifications and glass edge surface finishes specified above for monolithic, IGU and laminated glass panels also are applicable for the glass panels used in a given applied film glass unit construction. Glass beveling and polishing, and asymmetric rounding are also applicable to the individual panels used in an applied film glass unit of the present invention.

Figure 12:
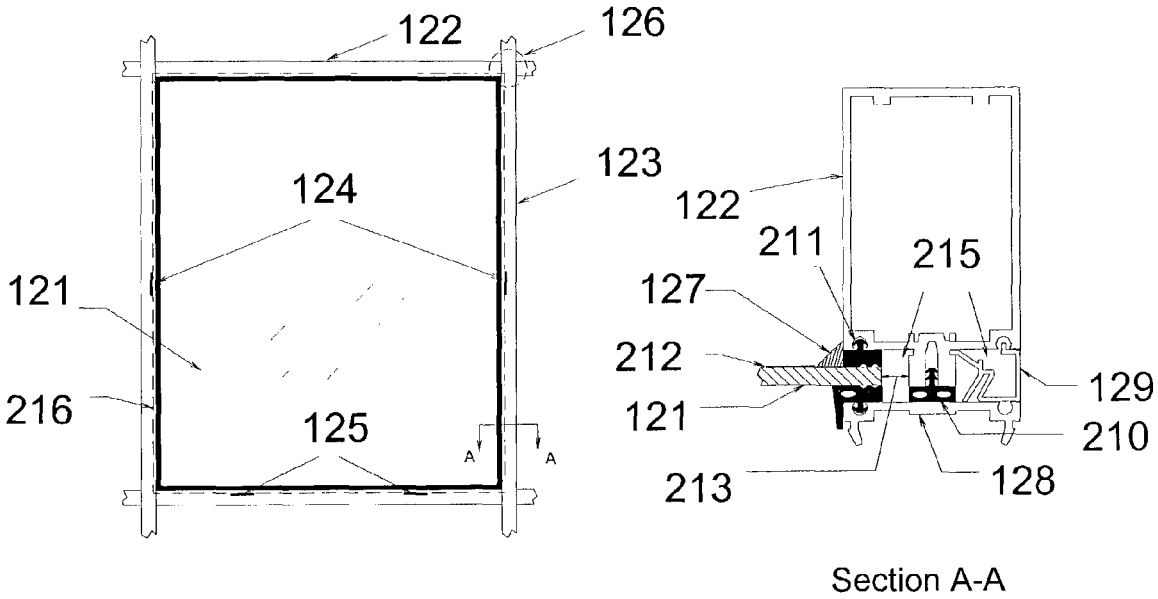
FIG. 12 is an elevation view and corresponding cross sectional view of the glazing details for an anchored film glass installation in a dry-glazed, curtain wall frame used in mid-rise building construction.

Additional glass fallout resistance can be imparted to applied film glass installations with modified-geometry (e.g., rounded) glass corners, as described previously, by anchorage of the film perimeter to the frame. One such embodiment of an anchored film rounded glass corner unit is shown in the elevation view and corresponding sectional view in FIG. 12. With reference to FIG. 12, the glass panel 121 with glass boundary 216 within the dry-glazed curtain wall frame section shown and bounded by extruded aluminum vertical mullions 123 and horizontal mullions 122, which are connected with shear blocks 126, rests upon rubber setting blocks 125 and maintains its side spacing 213 within the frame glazing pocket 215 with side blocks 124. The panel is secured within the frame with extruded aluminum pressure plates 128 and rubber gaskets 210 and 211. Additional glass panel attachment to the frame is provided by the structural silicone anchor bead 127 adhered to the film 212, which is applied to the glass panel and to the vertical and horizontal framing members along the entire glass panel perimeter. In framing those portions of a wall system that do not have glass panels on both sides of a given glazing pocket, an extruded aluminum perimeter filler is used 129. The use of anchored applied film is applicable to any of the aforementioned applied film glass panels of the present invention within a wide variety of wall framing systems.

For existing building wall systems constructed with glass panels containing annealed monolithic glass, it would be possible to retrofit those panels with modified-geometry (e.g., rounded) glass corners on site using commercially available, portable, glass cutting, sanding and grinding/polishing equipment. Alternatively, the original glass panels can be replaced with glass panels fabricated with modified-geometry (e.g., rounded) corners off site.

Glass panels of the present invention offer an economical seismic damage mitigation approach for architectural glass in both new buildings and existing buildings in earthquake-prone regions and elsewhere.

In accordance with the invention, the present invention is applicable to any window system, including, but not limited to curtain wall systems, storefront wall systems, punched opening window systems, ribbon window systems, and strip window systems.

Conventional framing for glass units has substantially rectangular or angular corner glazing pockets for receiving the rectangular or angular corners of conventional rectangular or angular glass panels. In accordance with our invention, a glass panel of the invention is mounted in conventional framing, which results in reducing the contact friction between the glass corners and the glazing pocket. The glass panels of the invention have a slightly reduced glass plate diagonal length, which allows them to rotate and translate more freely within the frame when the frame is subjected to dynamic, horizontal racking movements as would be expected during an earthquake. The increased mobility of the glass panel within its glazing pocket allows the glass panel to adjust more readily to increased frame deformation and can increase both the serviceability (glass cracking) and ultimate (glass fallout) drift limits of architectural glass panels.

In the preceding detailed descriptions, the present invention is described with reference to specific exemplary embodiments thereof. It will, however, be evident that various modifications and changes may be made thereto without departing from the broader spirit and scope of the present invention, as set forth in the claims. The specifications and drawings are, accordingly, to be regarded as illustrative and not restrictive. It is understood that the present invention is capable of using various other combinations and environments and is capable of changes or modifications within the scope of the inventive concept as expressed herein.

What is claimed is:

1. A building comprising at least one rectangular frame having an architectural glass panel within the rectangular frame, wherein the architectural glass panel has material removed at each corner and has finished edge surfaces and smooth edge contours in the corner regions and along the perimeter of the glass panel.

2. The building of claim 1 wherein the corners of the glass panel are rounded.

3. The building of claim 1 or 2 wherein the glass panel comprises annealed monolithic architectural glass, heat-strengthened monolithic architectural glass, fully tempered monolithic architectural glass, or chemically strengthened monolithic architectural glass.

4. The building of claim 1 or 2, wherein the glass panel comprises an insulating glass unit.

5. The building of claim 1 or 2, wherein the glass panel comprises a laminated glass unit.

6. The building of claim 1 or 2, wherein a polymeric film is adhered to the glass panel.

7. The building of claim 6, wherein the polymeric film is adhered to the glass panel with the edges of the film anchored to a glazing frame member.

8. The building of claim 1 or 2, wherein the glass panel is anchored to a glazing frame and wherein the glazing frame comprises metal, metal alloys, wood, polymeric materials, ceramics, or any combination of these materials.

9. The building of claim 7, wherein the glass panel has clean-cut, seamed, ground, polished, or some combination thereof, as the finished edge surfaces in the corner regions.

10. The building of claim 1 or 2, wherein the glass panel has shaped, ground, or polished edges and corner regions.

11. The building of claim 2, wherein the rounded corner glass panel has corner radii of about one half inch (about 13 mm) to about 2 inches (about 51 mm).

12. The building of claim 2, wherein the rounded corner glass panel has asymmetric radii or compound radii.

13. The building of claim 1 or 2 comprising a curtain wall wherein the at least one rectangular frame is an element of the curtain wall.

14. The building of claim 1 or 2 comprising a storefront wall system wherein the at least one rectangular frame is an element of the storefront wall system.

15. The building of claim 1 or 2 comprising a punched opening window system, wherein the at least one rectangular frame is an element of the punched opening window.

16. The building of claim 1 or 2 comprising a ribbon window system, wherein the at least one rectangular frame is an element of the ribbon window.

17. The building of claim 1 or 2 comprising a strip window system, wherein the at least one rectangular frame is an element of the strip window.

18. A method of increasing the earthquake damage resistance of an architectural glass panel within a building, the method comprising fitting an architectural glass panel having material removed at each corner and having finished edge surfaces and smooth edge contours in the corner regions and along the perimeter of the glass panel in a rectangular frame of a building.

19. A method of increasing the earthquake damage resistance of a glass panel in an existing building, the method comprising retrofitting or replacing a square or rectangular-cornered glass panel in the building with an architectural glass panel having material removed at each corner and having finished edge surfaces and smooth edge contours in the corner regions and along the perimeter of the glass panel.

20. A method of increasing the earthquake damage resistance of a glass panel within a building, the method comprising:

removing an original glass panel from a building;

modifying the corner region geometry of the original glass panel to form a glass panel having material removed at its corners and fabricated with smooth edge contours in the corner regions; and inserting the modified geometry glass panel back in the building.

21. The method of claim 18 wherein the material removed produces a glass panel having rounded corners.

22. A method of increasing the earthquake resistance of an architectural glass panel, comprising providing said glass panel in a rectangular frame of a building wherein said glass panel has modified-geometry corner means combined with edge finish means and edge profile means at the corners and along the perimeter for increasing said glass panel's ability to accommodate contacts with other glazing components during earthquakes, thereby increasing said glass panel's resistance to earthquake damage when in the rectangular frame of the building.

23. A glazed earthquake damage resistant architectural glass panel, comprising:

(a) at least one rectangular frame element, and (b) a rectangular architectural glass panel of predetermined dimensions and composition for its intended architectural use, and modified-geometry corner means combined with edge finish means and edge profile shape means at the corners and along the perimeter of said glass panel so as to increase said glass panel's ability to accommodate contacts with other glazing components during earthquakes whereby said glass panel's resistance to glass cracking and glass fallout damage is increased in said at least one rectangular frame element.

24. The glazed earthquake damage resistant architectural glass panel of claim 23, wherein said glazed earthquake damage resistant architectural glass panel is a component of said rectangular frame selected from the group of wall system types consisting of curtain wall, storefront, punched opening, ribbon, strip, and any combination thereof.

25. A method of increasing the earthquake damage resistance of a glazed architectural glass panel in an existing building, the method comprising replacing said glass panel in said existing building with a rectangular architectural glass panel of predetermined dimensions and composition for its intended architectural use, and modified-geometry corner means combined with edge finish means and edge profile shape means at the corners and along the perimeter of said glass panel so as to increase said glass panel's ability to accommodate contacts with other glazing components during earthquakes whereby said glass panel's resistance to glass cracking and glass fallout damage is increased.

26. A method of increasing the earthquake damage resistance of a glazed architectural glass panel in an existing building, the method comprising:

(a) removing said glass panel from said existing building;

(b) providing modified-geometry corner means combined with edge finish means and edge profile shape means at the corners and along the perimeter of said glass panel for increasing said glass panel's ability to accommodate contacts with other glazing components during earthquakes; and (c) reglazing said glass panel with modified geometry corner means in said building, whereby glass cracking and glass fallout resistance of said glass panel are increased.

* * * * *